US011006730B1

(12) United States Patent
DeVito

(10) Patent No.: US 11,006,730 B1
(45) Date of Patent: May 18, 2021

(54) PROPULSION SYSTEM FOR AN APPLIABLE PRODUCT AND METHOD OF USE

(71) Applicant: Wormser Corporation, Englewood, NJ (US)

(72) Inventor: Ralph James DeVito, Oxford, CT (US)

(73) Assignee: WORMSERGROUP, Englewood, NJ (US)

( * ) Notice: Subject to any disclaimer, the term of this patent is extended or adjusted under 35 U.S.C. 154(b) by 0 days.

(21) Appl. No.: 16/690,151

(22) Filed: Nov. 21, 2019

(51) Int. Cl.
*A45D 40/02* (2006.01)
*A45D 40/06* (2006.01)
*A45D 40/00* (2006.01)

(52) U.S. Cl.
CPC ..... *A45D 40/06* (2013.01); *A45D 2040/0025* (2013.01)

(58) Field of Classification Search
CPC ..... A45D 40/06; A45D 40/065; A45D 40/02; A45D 40/023; A45D 40/026; A45D 2040/0025; A45D 2040/0062; B65D 35/28; B65D 35/30; B65D 83/0005; B65D 83/0033; B65D 83/0066; B65D 83/0083; B05C 17/013; B05C 17/0116
USPC ..... 222/104
See application file for complete search history.

(56) References Cited

U.S. PATENT DOCUMENTS 1,631,931 A * 6/1927 Geake ..... B65D 83/0066 222/104
2,203,313 A * 6/1940 Thorn ..... B65D 83/0066 222/104
2,376,222 A * 5/1945 Barlow ..... B65D 83/0066 401/154
2,721,676 A * 10/1955 Andrews ..... B65D 83/0066 222/104

FOREIGN PATENT DOCUMENTS

GB 458234 * 12/1936 ..... B65D 83/00
GB 495856 * 11/1938 ..... B85D 83/00
GB 1582252 * 1/1981 ..... B65D 83/00

* cited by examiner

*Primary Examiner* — J C Jacyna
(74) *Attorney, Agent, or Firm* — Ted Masters

(57) ABSTRACT

A propulsion system for an appliable product, includes a distal tube which has an open end. A proximal tube is rotatably connected to the distal tube on a common central axis to form a cavity. A holder which carries the appliable product is shaped and dimensioned to slide in the cavity along the common central axis. A line having two strands connects the distal tube and the proximal tube. When the proximal tube is rotated with respect to the distal tube, the two strands of the line twist together and the line exerts a force upon the holder so that the holder moves toward the open end of the distal tube.

15 Claims, 8 Drawing Sheets

FIG. 5
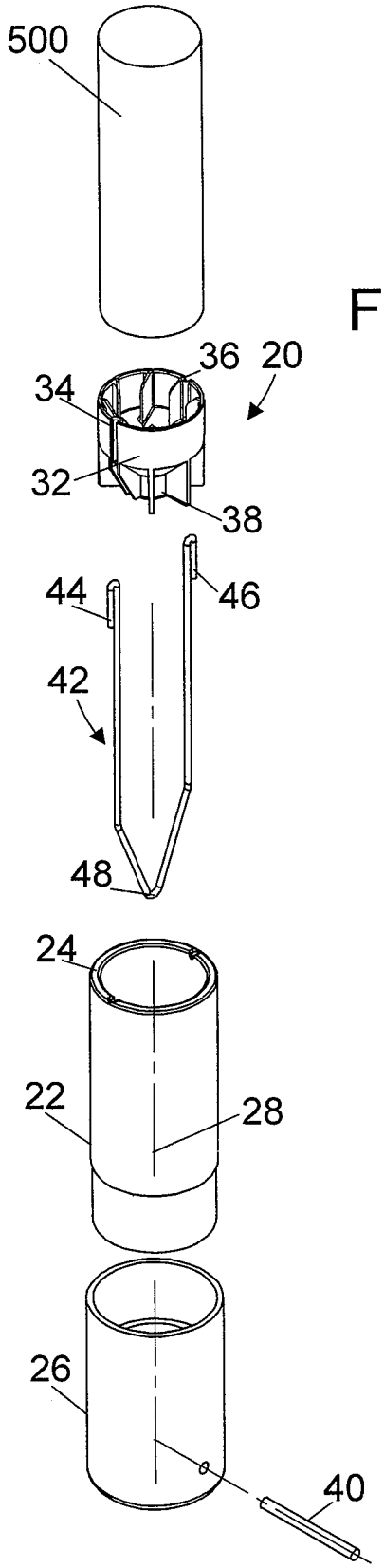
FIG. 6
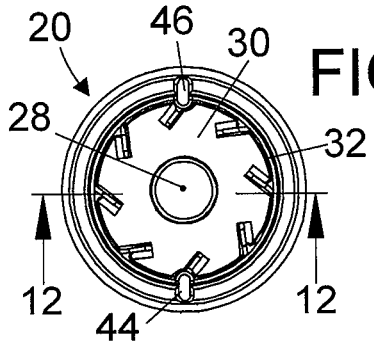
FIG. 7
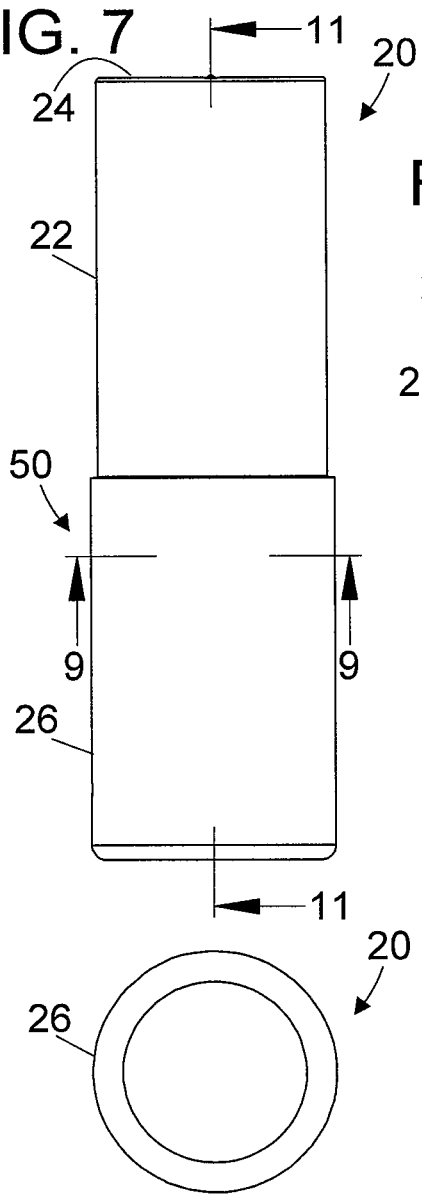
FIG. 8
FIG. 9
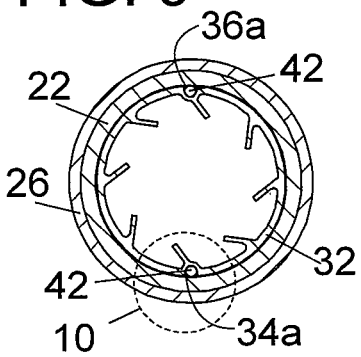
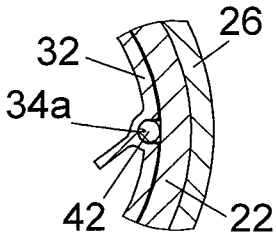
FIG. 10

FIG. 14
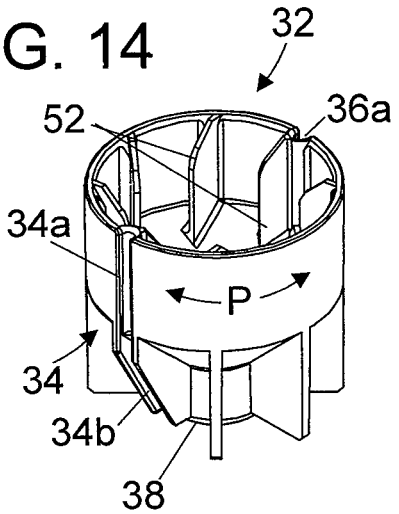
FIG. 16
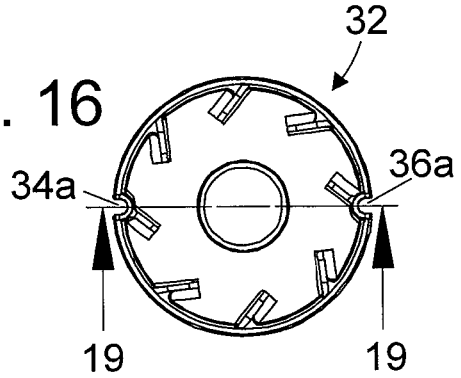
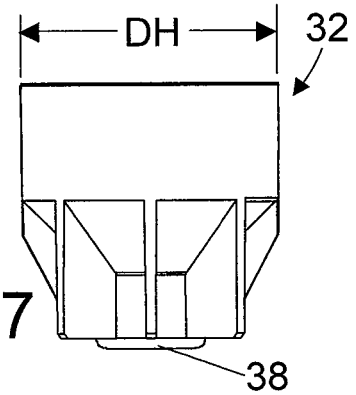
FIG. 17
FIG. 15
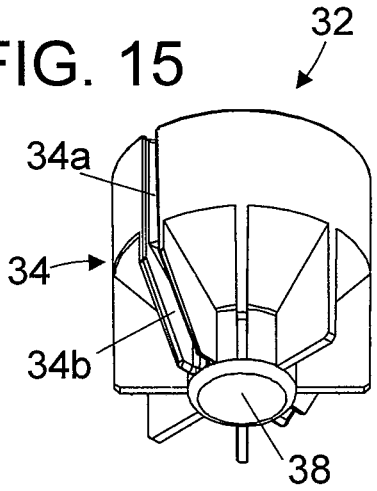
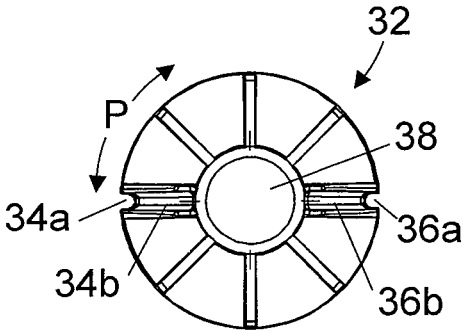
FIG. 18
FIG. 19
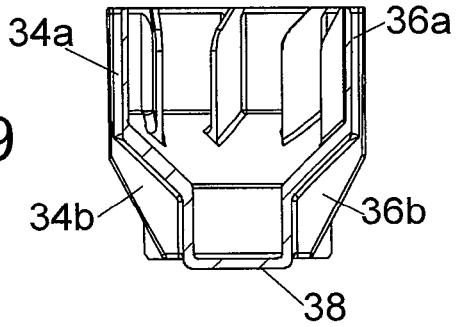

FIG. 20
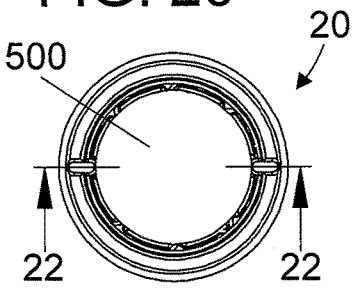
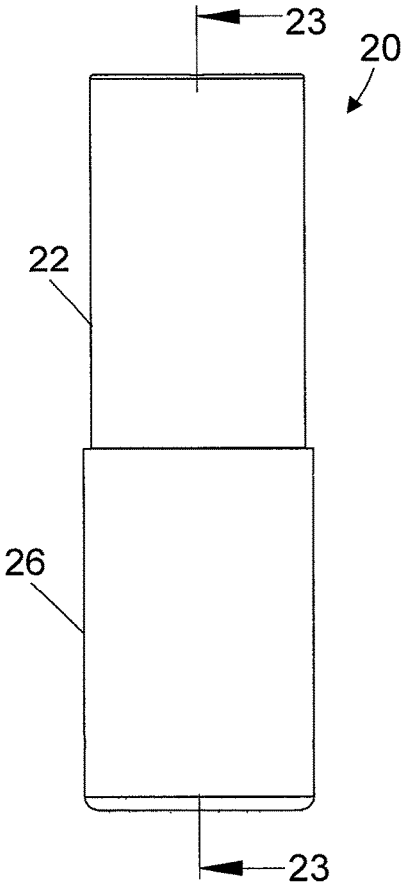
FIG. 21
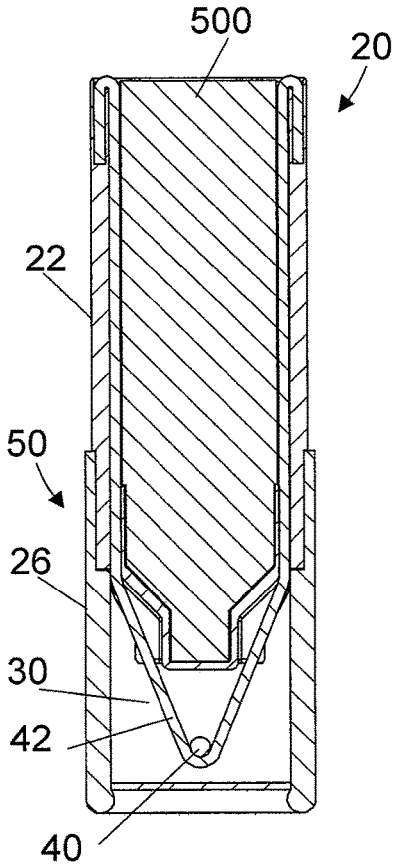
FIG. 22
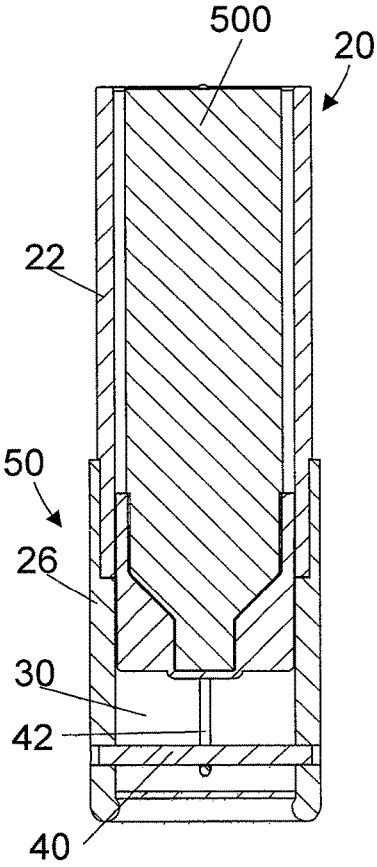
FIG. 23

FIG. 24
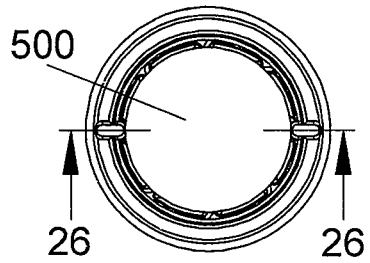
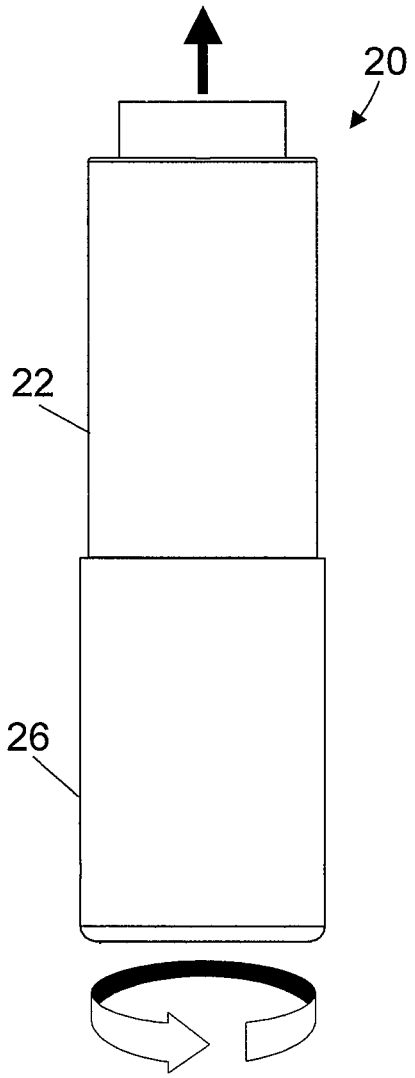
FIG. 25
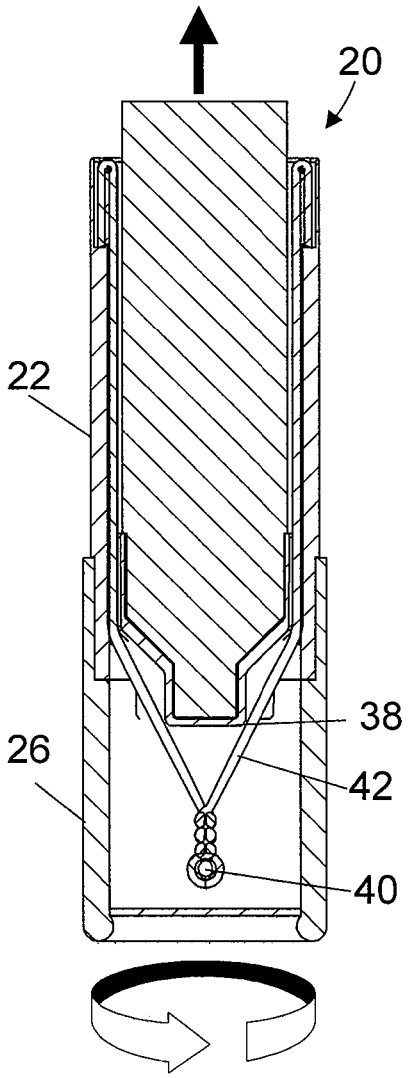
FIG. 26

FIG. 27
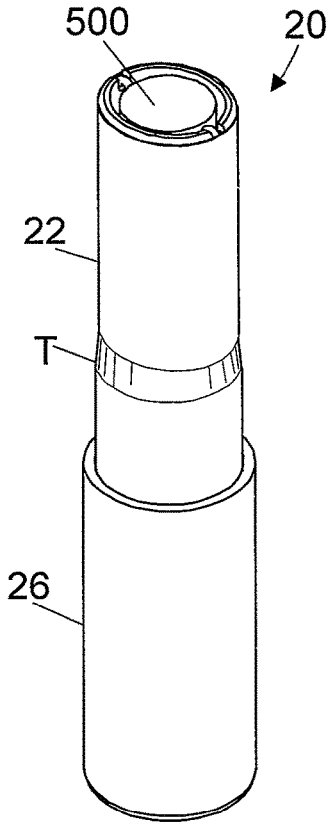
FIG. 28
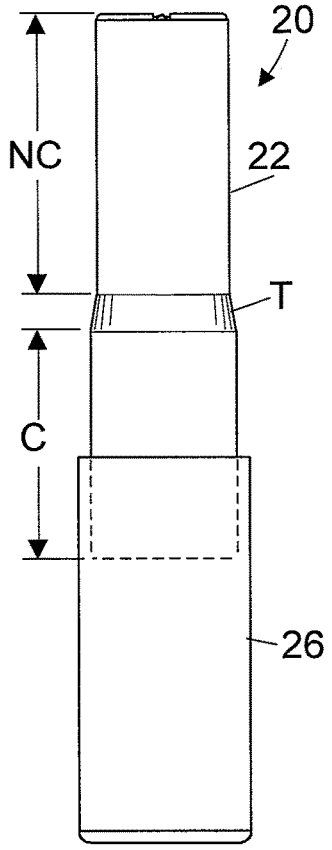
FIG. 29
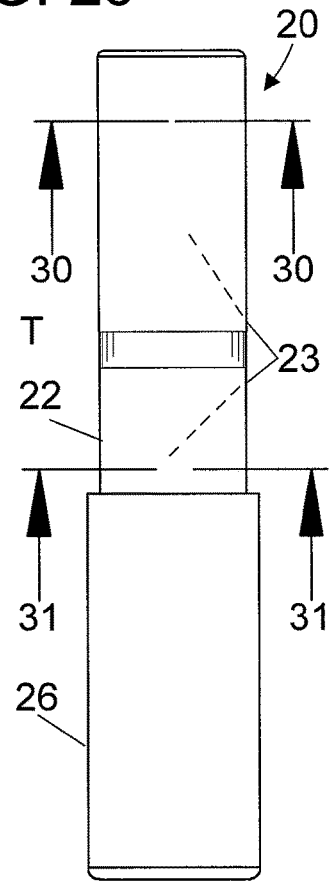
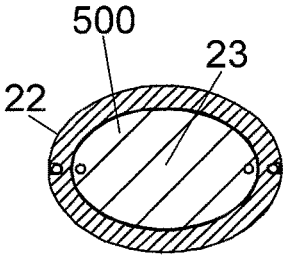
FIG. 30
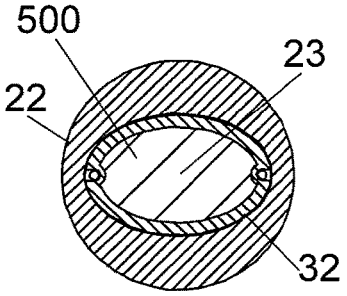
FIG. 31

PROPULSION SYSTEM FOR AN APPLIABLE PRODUCT AND METHOD OF USE

CROSS REFERENCE TO RELATED APPLICATION

None

TECHNICAL FIELD

The present invention pertains generally to products which are housed within an applicator, and can be placed in either a retracted stored position or an extended ready-for-use position. More particularly the invention pertains to a system and method for propelling an appliable product from the stored to the ready-for-use position.

BACKGROUND OF THE INVENTION

In the current art of spiral wound paper tube packaging, typically a hot-pour product is poured and chilled within a cylindrical tube. Both ends of the tube are open, and a cylindrical disk is present in the lower end of the tube, and serves as a floor/piston which can slide vertically within the tube when pressed from below. To use the product, the user removes an over cap, and places a finger up inside the lower end of the tube to press the floor/piston upwardly. This causes the solid cylindrical bulk to slide upwardly within the tube, exposing a portion of the bulk for use at the upper open tube end. As the product gets used, the piston must be pushed further and further upwardly, until the product is exhausted. This manual push method is cumbersome, and requires a tool such as a pencil to advance the bulk in smaller diameter tube packages where the finger will not fit inside.

BRIEF SUMMARY OF THE INVENTION

The present invention is directed to a propulsion system for an appliable product. The system comprises a distal (upper) tube which is rotationally connected to a proximal (lower) tube to form an internal cavity. The two tubes have a common inside diameter, a common central axis, and are connected by a load bearing step in their sidewalls which can withstand some axial compression pressure while still allowing rotation. A holder (aka cup) is situated within the tube's cavity. The holder has a floor and vertical sidewalls, the upper end being open. The holder is sized to fit inside the cavity and slide (translate) linearly along the common central axis. The upper end of the holder is a close fit to the Inside diameter of the cavity, such that a hot poured product can be filled into the holder and not have the product leak between the holder and the inside diameter. Two vertical channels are spaced at 180° are integral with the outside of the holder sidewall, such that the holder can hold a hot poured product, and allow a strand of line to fit within the vertical channel, and slide linearly inside of the channel.

The proximal tube has a cross beam assembled to be perpendicular to the common central axis. The cross beam is solidly affixed to the tube sidewall of the proximal tube at two points at 180 degrees. The cross beam is substantial enough to withstand a vertical force developed during the mechanisms function. A thin, flexible line such as nylon twine or similar tensile strand is anchored to one spot on the upper open end edge of the distal tube. The line is passed downwardly inside of the body, through one holder channel, around the cross beam, then back upwardly, through the other holder channel, then is affixed to the open edge of the distal tube at an opposite location. The two tubes are thereby joined together, but can rotate with respect to one another. In one embodiment, the distal tube has a non-circular section, and the holder has a matching non-circular shape.

In accordance with an embodiment, propulsion system for an appliable product includes a distal tube which has an open end. A proximal tube is rotatably connected to the to the distal tube on a common central axis to form a cavity. A holder is shaped and dimensioned to slide in the cavity along the common central axis. The holder has a perimeter. A first channel is disposed at the perimeter of the holder, and a second channel disposed at the perimeter of the holder in opposite relationship to the first channel. The proximal tube has an anchor. A line has a first end, a second end, and a middle. The first end of the line is connected to the distal tube, the middle of the line connected to the anchor, and the second end of the line is connected to the distal tube in opposite relationship to the first end of the line. The line passes through the first channel of the holder and the second channel of the holder.

In accordance with another embodiment, the distal tube and the proximal tube (1) each being cylindrical, and (2) each having the same inner diameter.

In accordance with another embodiment, the connection of the distal tube to the proximal tube includes a load bearing step.

In accordance with another embodiment, the first channel and the second channel each have (1) a distal section which is parallel to the common central axis, and (2) a proximal section which angles toward the common central axis and terminates at a boss.

In accordance with another embodiment, the holder has vanes which engage the appliable product.

In accordance with another embodiment, the first tube and the second tube have the same inner diameter. The holder has a diameter which is slightly less than the inner diameter.

In accordance with another embodiment, the anchor is a cross beam which resides in the cavity and which is fixedly connected to the proximal tube.

In accordance with another embodiment, rotation of the proximal tube with respect to the distal tube causes the line to twist together, wherein the line exertis a force upon the holder causing the holder to move toward the open end of the distal tube.

In accordance with another embodiment, the holder has a boss. The first channel and the second channel each have (1) a distal section which is parallel to the common central axis, and (2) a proximal section which angles toward the common central axis and terminates at the boss. The line exerts the force upon the boss.

In accordance with another embodiment, the distal tube has a cavity which is non-cylindrical.

In accordance with another embodiment, the distal tube has a non-cylindrical section, and the holder is non-cylindrical.

In accordance with an embodiment, a distal tube has an open end. A proximal tube is rotatably connected to the distal tube on a common central axis to form a cavity. A holder is shaped and dimensioned to slide in the cavity along the common central axis. A line having two strands connects the distal tube and the proximal tube, the line is twistable to exert a force upon the holder so that the holder moves toward the open end of the distal tube.

Other embodiments, in addition to the embodiments enumerated above, will become apparent from the following detailed description, taken in conjunction with the accompanying drawings, which illustrate, by way of example, the principles of the propulsion system for an appliable product and method of use.

BRIEF DESCRIPTION OF THE DRAWINGS

FIG. 5 is a reduced exploded perspective view of the propulsion system;

FIG. 6 is a top plan view of the propulsion system;

FIG. 7 is a side elevation view of the propulsion system;

FIG. 8 is a bottom plan view of the propulsion system:

FIG. 9 is a cross sectional view along the line 9-9 of FIG. 7;

FIG. 10 is an enlarged view of area 10 of FIG. 9;

FIG. 14 is an enlarged top perspective view of the holder;

FIG. 15 is an enlarged bottom perspective view of the holder;

FIG. 16 is an enlarged top plan view of the holder;

FIG. 17 is an enlarged side elevation view of the holder;

FIG. 18 is an enlarged bottom plan view of the holder;

FIG. 19 is a cross sectional view along the line 19-19 of FIG. 16;

FIG. 20 is top plan view of the propulsion system and applicable product;

FIG. 21 is a side elevation view of the propulsion system;

FIG. 22 is a cross sectional view along the line 22-22 of FIG. 20;

FIG. 23 is a cross sectional view along the line 23-23 of FIG. 21;

FIG. 24 is a top plan view of the propulsion system;

FIG. 25 is a side elevation view of the propulsion system;

FIG. 26 is a cross sectional view along the line 26-26 of FIG. 24;

FIG. 27 is a perspective view of a second embodiment of the propulsion system;

FIG. 28 is a side elevation view of the second embodiment;

FIG. 29 is a rotated side elevation view of the second embodiment;

FIG. 30 is a cross sectional view along the line 30-30 of FIG. 29; and, FIG. 31 is a cross sectional view along the line 31-31 of FIG. 29.

DETAILED DESCRIPTION OF THE INVENTION

Figure 1:
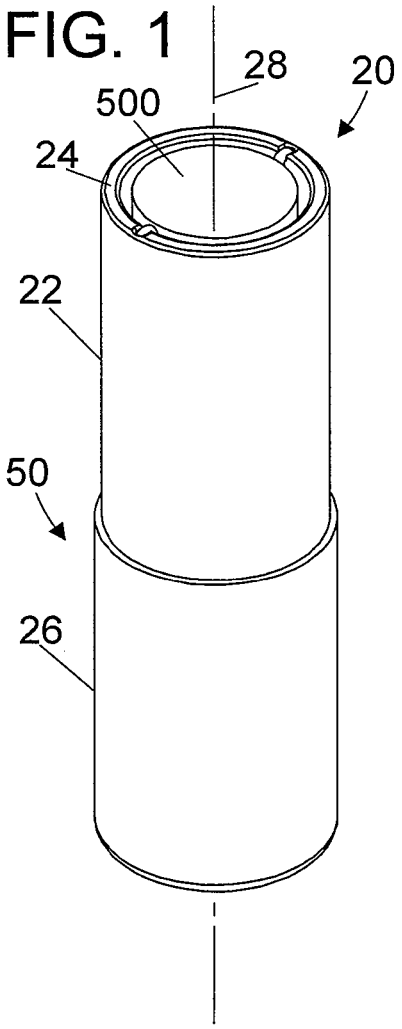
FIG. 1 is a perspective view of a propulsion system for an appliable product with the product in a stored position.
Figure 2:
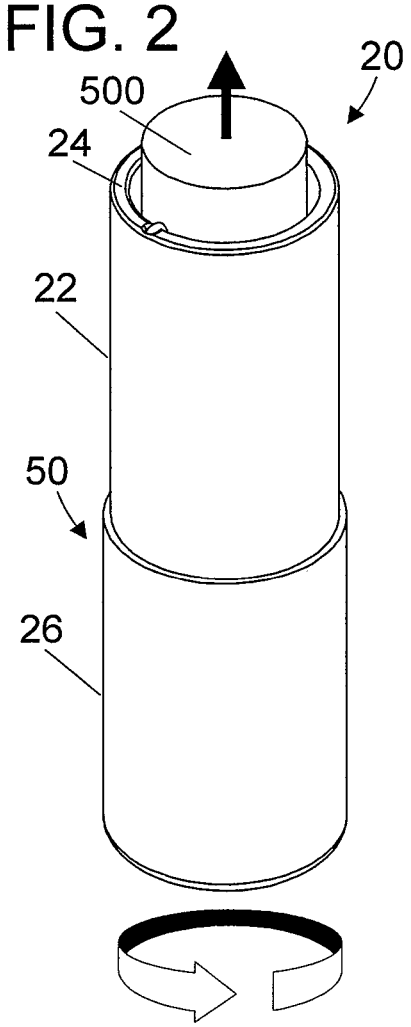
FIG. 2 is a perspective view of the propulsion system with the product in an extended ready-for-use position.
Figure 3:
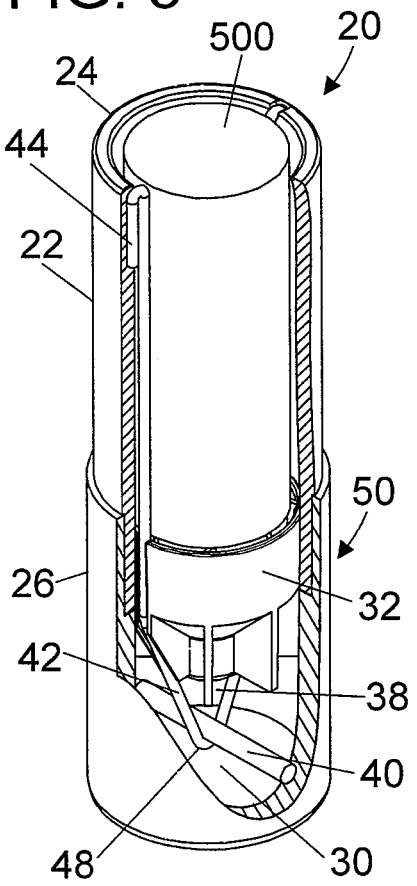
FIG. 3 is a perspective cutaway view of the propulsion system with the product in the stored position.
Figure 4:
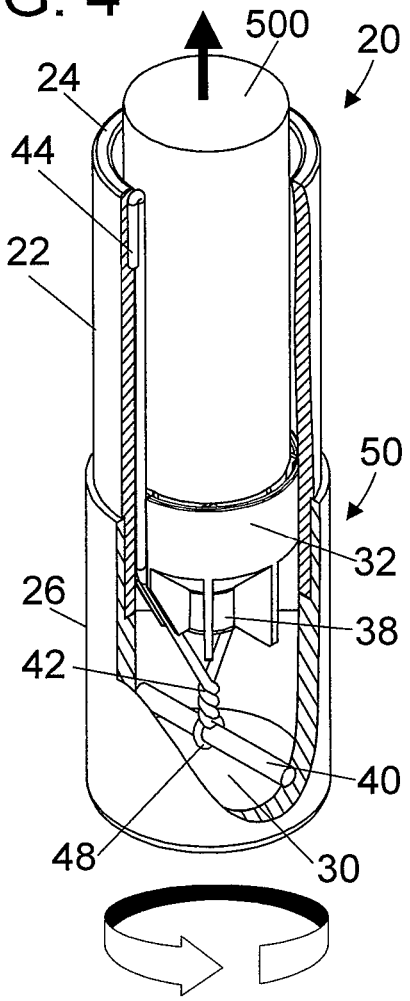
FIG. 4 is a perspective cutaway view of the propulsion system with the product in the extended ready-for-use position.

Referring initially to FIGS. 1-4, there are illustrated perspective views of a propulsion system 20 for an appliable product 500. FIG. 1. shows the appliable product 500 in a stored position within the propulsion system 20, and FIG. 2 shows the appliable product 500 in an extended ready-for-use position. FIGS. 3 and 4 show cutaway views of FIGS. 1 and 2 respectively, and FIG. 5 is a reduced exploded perspective view of propulsion system 20 and appliable product 500. Propulsion system 20 serves as an applicator for the appliable product 500. As used herein the term "appliable product" means a product which is amenable to transition from a retracted stored position to an extended ready-for-use position. Such products include but are not limited to: cosmetic products such as lipstick, makeup, blush, medicinal products such as pain killers, deodorants, lip moisturizers, and balms, glue, paint or other coloring, deodorizers, and the like. The appliable product 500 exists in solid stick form which may be selectively extended for use or withdrawn for storage. It is noted that FIGS. 1-4, and 20-30 include both propulsion system 20 and appliable product 500, and FIGS. 6-13 exclude the appliable product 500.

Propulsion system 20 includes a distal tube 22 having an open end 24, and a proximal tube 26. Proximal tube 26 is rotatably connected to distal tube 22 on a common central axis 28 to form a cavity 30 (also refer to FIGS. 6, and 11). In an embodiment, distal tube 22 and proximal tube 26 are both cylindrical (having a circular cross section) and have the same inner diameter D (refer also to FIG. 11), forming cylindrical cavity 30. Propulsion system 20 further includes a holder 32 (also referred to as a cup) which carries the applicable product 500 (also refer to FIGS. 14-19). Holder 32 is shaped and dimensioned to slide in cavity 30 along common central axis 28. Holder 32, has a circular perimeter P. A first channel 34 is disposed at perimeter P of holder 32, and a second channel 36 is disposed at perimeter P of holder 32 in opposite relationship to first channel 34. That is, the first channel 34 and the second channel 36 are on opposite sides of holder 32 (180° apart). First channel 34 and second channel 36 each have (1) a distal section (34*a* and 36*a* respectively) which is parallel to common central axis 28. First channel 34 and second channel 36 also each have a proximal section (34*b* and 36*b* respectively) which angles toward common central axis 28 and terminates at a boss 38.

Figure 11:
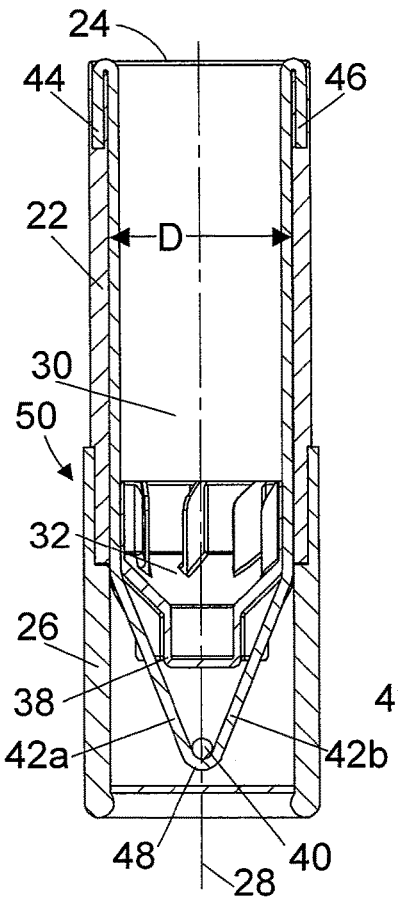
FIG. 11 is a cross sectional view along the line 11-11 of FIG. 7.
Figure 12:
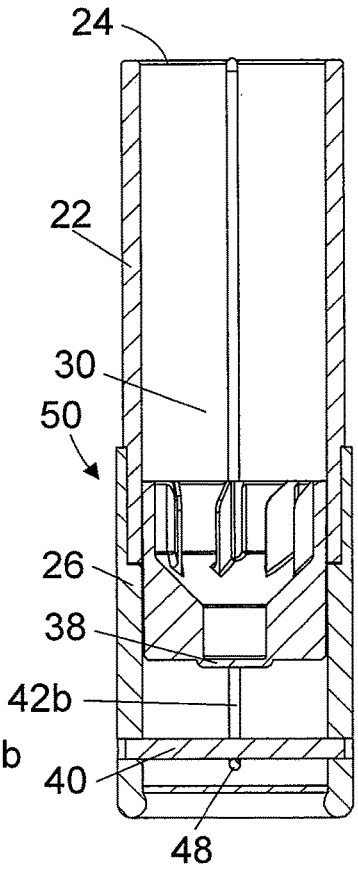
FIG. 12 is a cross sectional view along the line 12-12 of FIG. 6.

Proximal tube 26 includes an anchor 40. In the shown embodiment anchor 40 is a cross beam which resides in cavity 30 and which is fixedly connected to proximal tube 26. In the shown embodiment anchor 40 spans a diameter of proximal tube 26. A line 42 has a first end 44, a second end 46, and a middle 48. First end 44 of line 42 is connected to distal tube 22, and second end 44 of line 42 is connected to distal tube 22 in opposite relationship to first end 44. Middle 48 of line 42 is connected to anchor 40. In the shown embodiment first end 44 and second end 46 are connected around the rim of open end 24 of distal tube 22, and middle 48 is wrapped around anchor 40. Line 42 passes through first channel 34 and second channel 36 of holder 32. Line 42 can be any flexible material which can be twisted and untwisted without breaking. In an embodiment line 42 is made of a polymer such as nylon. In FIG. 5 FIGS. 11 and 12 it is noted that the connection of distal tube 22 to proximatal tube includes a load bearing step 50. Load bearing step 50 includes the outer surface of the proximal part of distal tube 22 having a reduced diameter, and the inner surface of the distal part of the proximal tube 26 having a reduce diameter, so that the proximal part of the distal tube 22 and the distal part of the proximal tube 26 fit together. It may be appreciated that the connection could be reversed wherein the outer surface of the distal surface of the proximal tube 26 has a reduced diameter, and the inner surface of the proximal part of the distal tube 22 has a reduced diameter.

Figure 13:
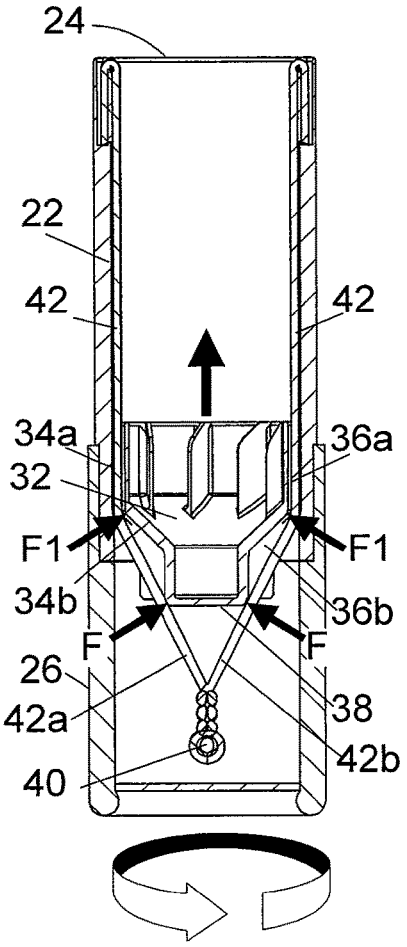
FIG. 13 is a cross sectional view as in FIG. 11 with a holder moved.

Referring to FIGS. 3, 4, and 13 it is noted that holder 32 carries the appliable product 500. Rotation of proximal tube 26 with respect to distal tube 22 causes line 42 to twist together (FIG. 4). When twisted line 42 exerts a force upon holder 32 causing holder 32 to move toward open end 24 of distal tube 22. As holder 32 moves, applicable product 500 is extended out of distal tube 22 so that it can be used. It is noted that while the rotation in FIGS. 2 and 4 is shown to be counterclockwise (when viewed from open end 24), a clockwise rotation will also cause the same result.

FIGS. 6-8 are top plan, side elevation, and bottom plan views respectively propulsion system 20, FIG. 9 is a cross sectional view along the line 9-9 of FIG. 7, and FIG. 10 is an enlarged view of area 10 of FIG. 9. Shown are distal tube 22, open end 24, proximal tube 26, common central axis 28, cavity 30, holder 32, distal section 34*a* of first channel 34, distal section 36*a* of second channel 36 and line 42.

FIG. 11 is a cross sectional view along the line 11-11 of FIG. 7, and FIG. 12 is a cross sectional view along the line 12-12 of FIG. 6. In these views proximal tube 26 has not been rotated. Shown are distal tube 22, open end 24, proximal tube 26, common central axis 28, cavity 30, boss 38, anchor 40, line 42, and load bearing step 50. It is noted that in an embodiment, first end 44 and second end 46 are connected to the rim of distal tube 22 located at open end 24.

FIG. 13 is a cross sectional view as in FIG. 11 with holder 32 moved toward open end 24 of distal tube 22 by rotating proximal tube 26 with respect to distal tube 22. Also referring to FIG. 11, it is noted that line 42 has two strands (42*a* and 42*b*) which emanate from anchor 40. The rotation of proximal tube 26 with respect to distal tube 22 causes line 42 (the two strands of line 42*a* and 42*b*) to twist together and exert a pinching force F on boss 38 of holder 32. The force F has a component along common central axis 28 (an upward component as shown) which serves to move (propel) holder 32 toward open end 24 of distal tube 22. Holder 32 slides toward open end 24 in cavity 30. It is noted that another force F1 is also exerted on holder 32 at the junction of distal section 34*a* and proximal section 34*b* of first channel 34, and distal section 36*a* and proximal section 36*b* of second channel 36 (also refer to FIGS. 14-19). Also shown are, open end 24, cavity 30, and anchor 40. It is noted that the first 34 and second 36 channels of holder 32 receive line 42. In an embodiment, the appliable product 500 (refer to FIGS. 1-4) is liquefied and poured into cavity 30 where it solidifies. The appliable product can then serve as a lubricant to facilitate the movement of holder 32 along line 42.

FIGS. 14-18 are enlarged top perspective, bottom perspective, top plan, side elevation, and bottom plan views respectively of holder 32. FIG. 19 is a cross sectional view along the line 19-19 of FIG. 16. Holder 32 has vanes which engage the appliable product 500 to retain the product in place within the holder. The vanes 52 are particularly useful when the appliable product 50 is poured into the cavity 30 (refer to FIG. 6). In FIG. 17 it is noted that holder 32 has a diameter DH which is slightly less than the inner diameter D of distal tube 22 and proximal tube 26. This is so holder 32 can freely slide within cavity 30, but will not pitch or yaw during the process. FIGS. 14-19 depict perimeter P, first channel 34 (including first section 34*a* and second section 34*b*), second channel 36 (including first section 36*a* and second section 36*b*), and boss 38.

FIG. 20 is top plan view of the propulsion system 20 and applicable product 500, FIG. 21 is a side elevation view of the propulsion system, FIG. 22 is a cross sectional view along the line 22-22 of FIG. 20, and FIG. 23 is a cross sectional view along the line 23-23 of FIG. 21. In these views the appliable product 500 is in the retracted stored position. Shown are distal tube 22, open end 24, proximal tube 26, boss 38, anchor 40, line 42, and load bearing step 50.

FIG. 24 is a top plan view of the propulsion system 20. FIG. 25 is a side elevation view of the propulsion system 20, and FIG. 26 is a cross sectional view along the line 26-26 of FIG. 24. In these views appliable product 500 is in the extended ready-for-use position. Shown are distal tube 22, open end 24, proximal tube 26, boss 38, anchor 40, and line 42.

FIG. 27 is a perspective view of a second embodiment of propulsion system 20, FIG. 28 is a side elevation view of the second embodiment, FIG. 29 is a rotated view (90°) of the second embodiment, FIG. 30 is a cross sectional view along the line 30-30 of FIG. 29, and, FIG. 31 is a cross sectional view along the line 31-31 of FIG. 29. Referring also to FIG. 4, the twisting of line 42 can cause a rotational force on the holder 32. For larger diameter systems, this is not an issue, as it can rotate a small amount without effect. However, for the smaller diameter systems (shown), the rotational force can be sufficient to rotate the holder 32 180 degrees causing the system to jam. To keep the holder 32 from rotating, a holder 32 shape other than circular can be used within a matching distal tube cavity 23 (oval shown in illustrations, but other shapes are also possible). In the shown embodiment cavity 30 includes a distal tube cavity 23 which is non-cylindrical (oval as shown). The perimeter of holder 32 also has a corresponding non-cylindrical oval shape so that it can slide within distal tube cavity 23. This prevents holder 32 from rotating when proximal tube 26 is rotated with respect to distal tube 22. It is noted however that the proximal section (lower as shown) of distal tube 22 must be circular so that it can rotate with respect to proximal tube 26 (refer to FIG. 31). It is noted that the external appearance of the second embodiment of propulsion system 20 can take different forms. Referring to FIG. 28, in the shown embodiment the upper section of distal tube 22 is oval non-circular (NC), while the lower section of distal tube 22 is circular (C). A transition section T is disposed between the non-circular section (NC) and the circular section (C).

Though not shown it may be appreciated that propulsion system 20 can include a removable cap which fits over open end 24 of distal tube 22, and protects appliable product 500 when not in use. The cap is removed prior to use.

Operation: (refer to FIGS. 1-5) The cap (if provided) is removed and the distal tube 22 is held in one hand, while the proximal tube 26 is rotated on axis in relation to the distal tube 22. As the proximal tube 26 is rotated in relation to the distal tube 22, the two strands of line 42 which are adjacent anchor 40 become twisted together between the anchor 40 and the boss 38 of of holder 32. For each new rotation of the proximal tube 26, a new twist is accumulated between the previous twist, and the boss 38 of the holder 32. Since the anchor 40 position is fixed, and the length of the twisted section of the strands increases as the proximal tube 26 is turned, the holder 32 is forced toward open end 24 of distal tube 22 from it's initial position, by a length equal to the length of the new twist.

The continued rotation of the proximal tube 26 relative to the distal tube 22 causes the holder 32 to continue to move toward open end 24, thereby causing the appliable product 500 to extend outside the distal tube 22 so that it can be used. During use of the appliable product 500 holder 32 will remain stationary and extended even with a force is applied as a result of product application. This is because a downward force on holder 32 does not translate into a rotational force high enough to cause the proximal tube 26 to rotate and unwind the twisted strands. The rotation of proximal tube 26 in one direction causes holder 32 to move and thereby extend the appliable product for use. To retract the applicable product, the proximal tube 26 must be rotated in the opposite direction while applying a light downward pressure to the appliable product 500. The holder 32 and applicable product 500 will move inwardly under pressure, at a distance relative to the amount of rotation.

In view of the above, a method for propelling an appliable product 500 includes: (refer to FIGS. 1-31:

(a) providing a propulsion system for the appliable product 500, including;

a distal tube 22 having an open end 24;

a proximal tube 26, the proximal tube 25 rotatably connected to the distal tube 22 on a common central axis 28 to form a cavity 30;

a holder 32 which carries the applicable product 500, the holder 32 shaped and dimensioned to slide in the cavity 30 along the common central axis 28;

the holder 32 having a perimeter P, a first channel 34 disposed at the perimeter P of the holder 32, and a second channel 36 disposed at the perimeter P of the holder 32 in opposite relationship to the first channel 34;

the proximal tube 26 having an anchor 40;

a line 42 having a first end 44, a second end 46, and a middle 48;

the first end 44 of the line 42 connected to the distal tube 22;

the middle 48 of the line 42 connected to the anchor 40;

the second end 46 of the line 42 connected to the distal tube 22 in opposite relationship to the first end 44 of the line 42;

the line 42 passing through the first channel 34 of the holder 32 and the second channel 36 of the holder 32; and, (b) rotating the proximal tube 26 with respect to the distal tube 22 wherein the line 42 twists together and exerts a force F upon the holder 32 causing the holder 32 and appliable product 500 to move toward the open end 24 of the distal tube 22.

The method further including:

in (a), the rotatable connection of the distal tube 22 to the proximal tube 26 including a load bearing step 50; and, in (b), the load bearing step 50 rotating.

The method further including:

in (a), the anchor 40 being a cross beam which resides in the cavity 30 and which is fixedly connected to the proximal tube 26; and, in (b) the line 42 wrapped abound the cross beam to effect the twisting.

The method further including:

in (a), the first channel 34 and the second channel 36 each having (1) a distal section (34*a* and 36*a* respectively) which is parallel to the common central axis 28, and (2) a proximal section (34*b* and 36*b* respectively) which angles toward the common central axis 28 and terminates at a boss 38; and, in (b), the force F exerted on the boss 38.

The embodiments of the propulsion system for a appliable product and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the system and method should be construed as limiting the invention to a particular embodiment or combination of embodiments. The scope of the invention is defined by the appended claims.

I claim:

1. A propulsion system for an appliable product, comprising a distal tube having an open end;

a proximal tube, said proximal tube rotatably connected to said distal tube on a common central axis to form a cavity;

a holder, said holder shaped and dimensioned to slide in said cavity along said common central axis;

said holder having a perimeter, a first channel disposed at said perimeter of said holder, and a second channel disposed at said perimeter of said holder in opposite relationship to said first channel;

said proximal tube having an anchor;

a line having a first end, a second end, and a middle;

said first end of said line connected to said distal tube;

said middle of said line connected to said anchor;

said second end of said line connected to said distal tube in opposite relationship to said first end of said line; and, said line passing through said first channel of said holder and said second channel of said holder.

2. The propulsion system according to claim 1, further including:

said distal tube and said proximal tube (1) each being cylindrical, and (2) each having the same inner diameter.

3. The propulsion system according to claim 1, further including:

said connection of said distal tube to said proximal tube including a load bearing step.

4. The propulsion system according to claim 1, further including:

said first channel and said second channel each having (1) a distal section which is parallel to said common central axis, and (2) a proximal section which angles toward said common central axis and terminates at a boss.

5. The propulsion system according to claim 1, further including:

said holder having vanes which engage the appliable product.

6. The propulsion system according to claim 1, further including:

said first tube and said second tube having the same inner diameter; and, said holder having a diameter which is slightly less than said inner diameter.

7. The propulsion system according to claim 1, further including:

said anchor being a cross beam which resides in said cavity and which is fixedly connected to said proximal tube.

8. The propulsion system according to claim 1, further including:

rotation of said proximal tube with respect to said distal tube causing said line to twist together; and, said line exerting a force upon said holder causing said holder to move toward said open end of said distal tube.

9. The propulsion system according to claim 8, further including:

said holder having a boss;

said first channel and said second channel each having (1) a distal section which is parallel to said common central axis, and (2) a proximal section which angles toward said common central axis and terminates at said boss; and, said line exerting said force upon said boss.

10. The propulsion system according to claim 1, further including:

said cavity including a distal tube cavity; and, said distal tube cavity being non-cylindrical.

11. The propulsion system according to claim 1, further including:

said distal tube and said proximal tube (1) each being cylindrical, and (2) each having the same inner diameter;

said connection of said distal tube to said proximal tube including a load bearing step;

said first channel and said second channel each having (1) a distal section which is parallel to said common central axis, and (2) a proximal section which angles toward said common central axis and terminates at a boss;

said first tube and said second tube having the same inner diameter;

said holder having a diameter which is slightly less than said inner diameter;

said anchor being a cross beam which resides in said cavity and which is fixedly connected to said proximal tube;

rotation of said proximal tube with respect to said distal tube causing said line to twist together;

said line exerting a force upon said holder causing said holder and the appliable product to move toward said open end of said distal tube;

said holder having a boss;

said first channel and said second channel each having (1) a distal section which is parallel to said common central axis, and (2) a proximal section which angles toward said common central axis and terminates at said boss; and, said line exerting said force upon said boss.

12. A method for propelling an appliable product, comprising:

(a) providing a propulsion system for the appliable product, including;

a distal tube having an open end;

a proximal tube, said proximal tube rotatably connected to said distal tube on a common central axis to form a cavity;

a holder which carries the applicable product, said holder shaped and dimensioned to slide in said cavity along said common central axis;

said holder having a perimeter, a first channel disposed at said perimeter of said holder, and a second channel disposed at said perimeter of said holder in opposite relationship to said first channel;

said proximal tube having an anchor;

a line having a first end, a second end, and a middle;

said first end of said line connected to said distal tube;

said middle of said line connected to said anchor;

said second end of said line connected to said distal tube in opposite relationship to said first end of said line;

said line passing through said first channel of said holder and said second channel of said holder; and, (b) rotating said proximal tube with respect to said distal tube wherein said line twists together and exerts a force upon said holder causing said holder and the appliable product to move toward said open end of said distal tube.

13. The method of claim 12, further including:

in (a), said rotatable connection of said distal tube to said proximal tube including a load bearing step; and, in (b), said load bearing step rotating.

14. The method according to claim 12, further including:

in (a), said anchor being a cross beam which resides in said cavity and which is fixedly connected to said proximal tube; and, in (b) said line wrapped abound said cross beam to effect said twisting.

15. The method according to claim 12, further including:

in (a), said first channel and said second channel each having (1) a distal section which is parallel to said common central axis, and (2) a proximal section which angles toward said common central axis and terminates at a boss; and, in (b), said force exerted on said boss.

* * * * *